US007513499B2

(12) United States Patent
Müller et al.

(10) Patent No.: US 7,513,499 B2
(45) Date of Patent: Apr. 7, 2009

(54) SHEET BRAKE USING A PARTITIONED BLOWER NOZZLE ARRAY

(75) Inventors: Andreas Müller, Heidelberg (DE); Andreas Detloff, Walldorf (DE); Peter Hachmann, Dossenheim (DE); André Kreller, Wiesloch (DE); Michael Pasuch, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 233 days.

(21) Appl. No.: 11/122,807

(22) Filed: May 4, 2005

(65) Prior Publication Data

US 2007/0001385 A1 Jan. 4, 2007

(30) Foreign Application Priority Data

May 4, 2004 (DE) ..... 10 2004 022 343

(51) Int. Cl.
*B65H 29/68* (2006.01)

(52) U.S. Cl. ..... 271/183; 271/204; 101/232; 101/480

(58) Field of Classification Search ..... 271/182, 271/183, 204; 101/232, 480
See application file for complete search history.

(56) References Cited

U.S. PATENT DOCUMENTS

| | | | | |
|---|---|---|---|---|
| 3,477,558 | A * | 11/1969 | Fleischauer | 198/689.1 |
| 4,165,132 | A * | 8/1979 | Hassan et al. | 406/10 |
| 4,643,414 | A * | 2/1987 | Weisgerber | 271/183 |
| 4,819,928 | A * | 4/1989 | Osborn et al. | 271/276 |
| 5,411,251 | A * | 5/1995 | Schmid et al. | 271/195 |
| 5,505,124 | A * | 4/1996 | Esposito | 101/142 |
| 5,718,176 | A | 2/1998 | Stephan | |
| 5,927,203 | A * | 7/1999 | Gieser et al. | 101/419 |
| 6,270,074 | B1 * | 8/2001 | Rasmussen et al. | 271/276 |
| 6,315,287 | B1 * | 11/2001 | Hirth et al. | 271/182 |
| 6,543,765 | B2 * | 4/2003 | Kerpe et al. | 271/195 |
| 6,557,468 | B2 * | 5/2003 | Kelm et al. | 101/242 |
| 6,585,263 | B1 * | 7/2003 | Bredenberg et al. | 271/276 |
| 6,612,235 | B2 | 9/2003 | Frankenberger et al. | |
| 2002/0078842 | A1 * | 6/2002 | Frankenberger et al. | 101/232 |

FOREIGN PATENT DOCUMENTS

| | | |
|---|---|---|
| DE | 42 09 067 A1 | 9/1993 |
| DE | 42 42 730 A1 | 6/1994 |
| DE | 44 06 739 A1 | 9/1995 |
| DE | 195 45 799 C1 | 1/1997 |
| DE | 195 27 441 A1 | 2/1997 |
| DE | 196 31 598 A1 | 2/1998 |
| DE | 198 57 745 A1 | 6/2000 |
| DE | 199 05 095 A1 | 8/2000 |
| EP | 1 184 173 A2 | 3/2002 |
| GB | 231606 | 1/1924 |

* cited by examiner

*Primary Examiner*—Patrick H Mackey
*Assistant Examiner*—Gerald W McClain
(74) *Attorney, Agent, or Firm*—Laurence A. Greenberg; Werner H. Stemer; Ralph E. Locher

(57) ABSTRACT

A sheet brake for braking sheets made from a printing material contains circulating brake elements and at least one sheet support that is disposed between the brake elements and forms a blowing device. The sheet support contains a first nozzle array having air nozzles and a second nozzle array having air nozzles. The air nozzles of the first nozzle array are configured to produce blown air volumetric flows, which are smaller than blown air volumetric flows from the air nozzles of the second nozzle array.

9 Claims, 4 Drawing Sheets

SHEET BRAKE USING A PARTITIONED BLOWER NOZZLE ARRAY

BACKGROUND OF THE INVENTION

Field of the Invention

The present invention relates to a sheet brake for braking sheets made from a printing material. The sheet brake has circulating brake elements and at least one sheet support that is disposed between the brake elements and forms a blowing device.

A sheet brake of this type is shown, for example, on pages 1 to 19 of the operating guide published by MAN Roland Druckmaschinen AG Airglide for the printing press Roland 700. An unfavorable aspect of the sheet brake is that the blown air volumetric flow of the blowing device has to be set by a valve. The setting has to be performed as a function of the weight per unit area of the sheet. In the case of a weight per unit area, which changes from print job to print job, the setting must be performed quite frequently. For this reason, the changeover time is high. Moreover, waste paper can be produced and ink can be smeared from the sheets onto the blowing device, if an incorrect value has been set. The blowing device has to be cleaned, in order to free it of the smeared ink. The maintenance time rises as a consequence.

Published, European patent application EP 1 184 173 A2 (corresponding to U.S. Pat. No. 6,612,235), which forms the more remote prior art is not capable of adding an effective contribution to solving the above-mentioned problems. In this patent application, a sheet-guiding device is described, at whose locations which are endangered by contact restricted air nozzles are disposed.

SUMMARY OF THE INVENTION

It is accordingly an object of the invention to provide a sheet brake that overcomes the above-mentioned disadvantages of the prior art devices of this general type, which is easier to operate.

The sheet brake according to the invention for braking sheets made from a printing-material, has circulating brake elements and at least one sheet support which is disposed between the brake elements and forms a blowing device. The sheet brake is distinguished by the fact that the sheet support contains a first nozzle array having air nozzles and a second nozzle array having air nozzles, and by the fact that the air nozzles of the first nozzle array are configured to produce blown air volumetric flows which are smaller than blown air volumetric flows from the air nozzles of the second nozzle array.

In the sheet brake according to the invention, there is no need to set the blowing device as a function of the weight per unit area of the sheet. As a result, the changeover time is reduced. High functional reliability is ensured not only independently of the weight per unit area of the sheet, but also independently of the machine speed. In the sheet brake according to the invention, there is no need for setting operations, which serve to adapt the blown air to changes in the machine speed. However, the sheet brake according to the invention is not only easy to operate, it is also very easy to maintain. Smearing of the ink from the sheet onto the sheet support is avoided in all circumstances, with the result that frequent cleaning of the sheet support is not required. Waste paper is also reduced as a consequence.

In one development, the air nozzles of the second nozzle array are throttled to a lesser extent than the air nozzles of the first nozzle array. Accordingly, both the air nozzles of the second nozzle array and the air nozzles of the first nozzle array are throttled air nozzles, that is to say air nozzles with air restrictors (restrictor nozzles) integrated into them or air nozzles with air restrictors connected ahead of them. However, the throttling action of the air restrictors of the second nozzle array is smaller than the throttling action of the air restrictors of the first nozzle array. This difference with regard to the throttling action can be realized, for example, in that the air restrictors of the second nozzle array in each case have fewer eddy chambers than the air nozzles of the first nozzle array.

A further development has the content that the air nozzles of the first nozzle array and the air nozzles of the second nozzle array are assigned labyrinthine air restrictors for producing the different blown air volumetric flows. The labyrinthine air restrictors can have in each case a labyrinth, which is formed, for example, by a bulk filling, by a spiral air duct, by protruding air baffles or by perforated plates. With regard to the configuration of the abovementioned labyrinth shapes, published, European patent application EP 1 184 173 A2 (corresponding to U.S. Pat. No. 6,612,235) (see FIGS. 4, 6*a* to 8 and associated parts of the description) is incorporated herein by reference into the instant application. With regard to the labyrinthine configuration of the air restrictors, published, non-prosecuted German patent application DE 44 06 739 A1 (corresponding to U.S. Pat. No. 5,505,124) is likewise incorporated by reference herein into the instant invention.

In a further development, with regard to the sheet support, the first nozzle array is disposed relatively centrally and the second nozzle array is disposed relatively decentrally. The second nozzle array is therefore situated closer than the first nozzle array to the edge of the nozzle surface of the sheet support having the nozzle arrays. The edge is particularly at risk with regard to smearing of the ink from the sheet and is therefore protected against smearing in an optimum manner by the greater blown air volumetric flows of the second nozzle array. The risk of smearing is substantially smaller in the central region of the nozzle surface, so that the smaller blown air volumetric flows of the first nozzle array are sufficient there for the formation of an air cushion which bears the sheet in a contactless manner. As a result of the fact that the blown air volumetric flows are smaller in the first nozzle array, it is ensured that the blowing device does not impair the deposition behavior of the sheet, even if the latter has the lowest possible weight per unit area, as a result of excessive air beneath the sheet or does not raise the sheet from the circulating brake elements. Contact between the brake elements and the sheet which is to be braked is ensured during the braking time.

According to a further development, the first nozzle array is surrounded annularly by the second nozzle array. Accordingly, the second nozzle array forms a circular, oval or polygonal ring, which extends around the first nozzle array. The ring can have interruptions, for example in the form of nozzle-free regions, at one or more locations.

According to a further development, the nozzle surface of the sheet support is curved. The curvature is present only at the circumferential edge of the nozzle surface and that part of the nozzle surface, which is surrounded by the edge curvature is flat.

According to a further development, the sheet support has nozzle densities, which differ from one another from nozzle array to nozzle array. Therefore, the air nozzles in the first nozzle array are disposed at a different nozzle distance which is to be measured from air nozzle to adjacent air nozzle than the air nozzles in another nozzle array of the nozzle surface, for example in the second nozzle array or in a third nozzle array. The nozzle density preferably increases from the center of the nozzle surface toward its edge.

In a further development, the sheet support and a further sheet support of this type are disposed in a row between the brake elements. The sheet brake therefore contains here a multiplicity of sheet supports, which are configured so as to be structurally identical to one another and different than the braking units. The sheet supports are disposed close to one another and between two of the brake elements.

The sheet brake, which is configured according to the invention or according to one of the developments is preferably a constituent part of a sheet deliverer, and the latter is preferably a constituent part of a printing press, preferably a perfector printing press.

Other features which are considered as characteristic for the invention are set forth in the appended claims.

Although the invention is illustrated and described herein as embodied in a sheet brake, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
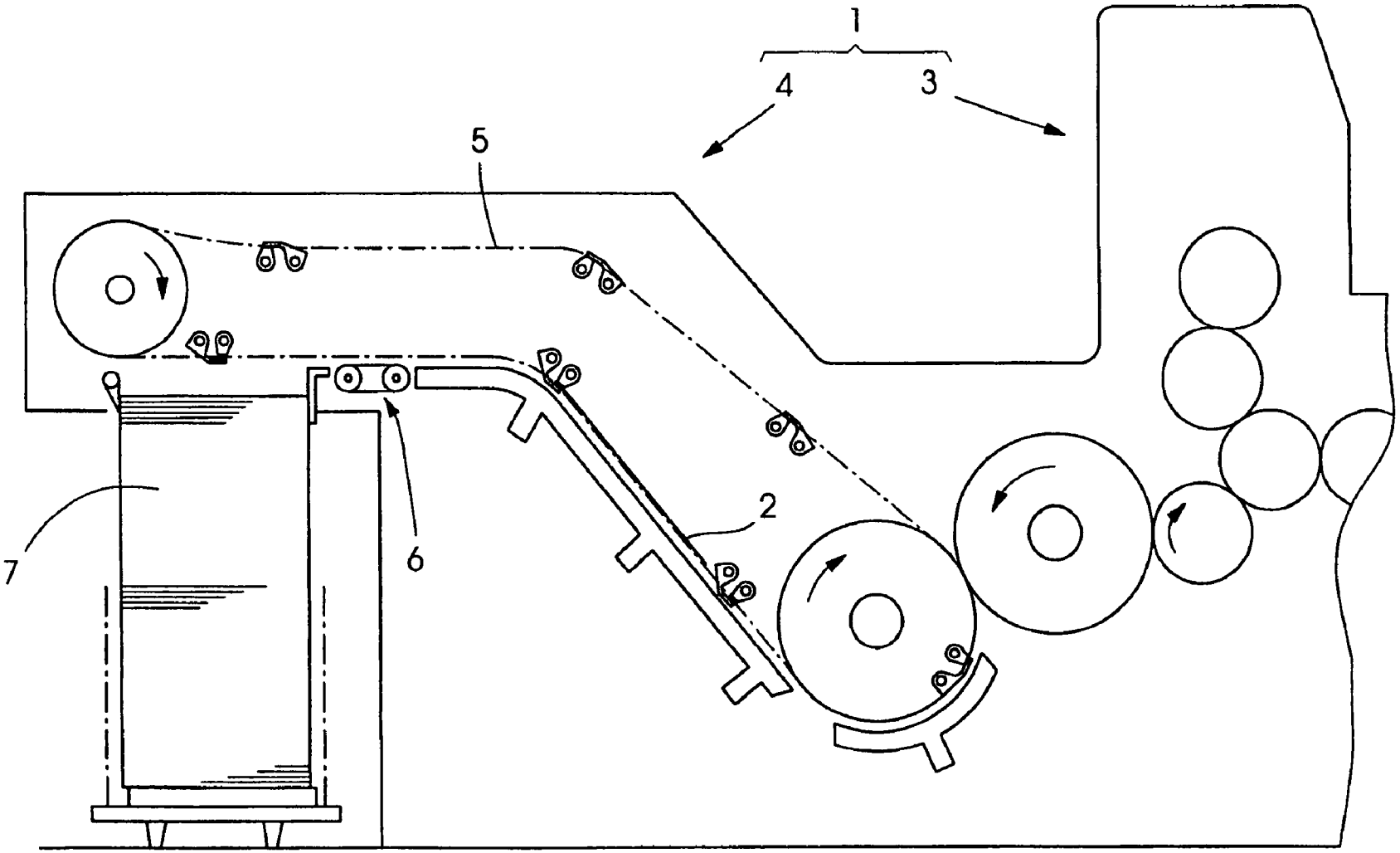
FIG. 1 is a diagrammatic, side-elevational view of a printing press having a sheet deliverer with a sheet brake according to the invention.

Referring now to the figures of the drawing in detail and first, particularly, to FIG. 1 thereof, there is shown a machine 1 for processing sheets 2 made from a printing material. The machine 1 is a printing press and contains a printing unit 3 for lithographic offset printing and a sheet deliverer 4 having a chain conveyor 5. The machine 1 preferably contains a plurality of printing units of this type and is a perfector printing press for printing both sides of the sheet. A sheet brake 6 which brakes the sheets 2 before they are deposited on a sheet stack 7 is disposed below the chain conveyor 5.

Figure 2:
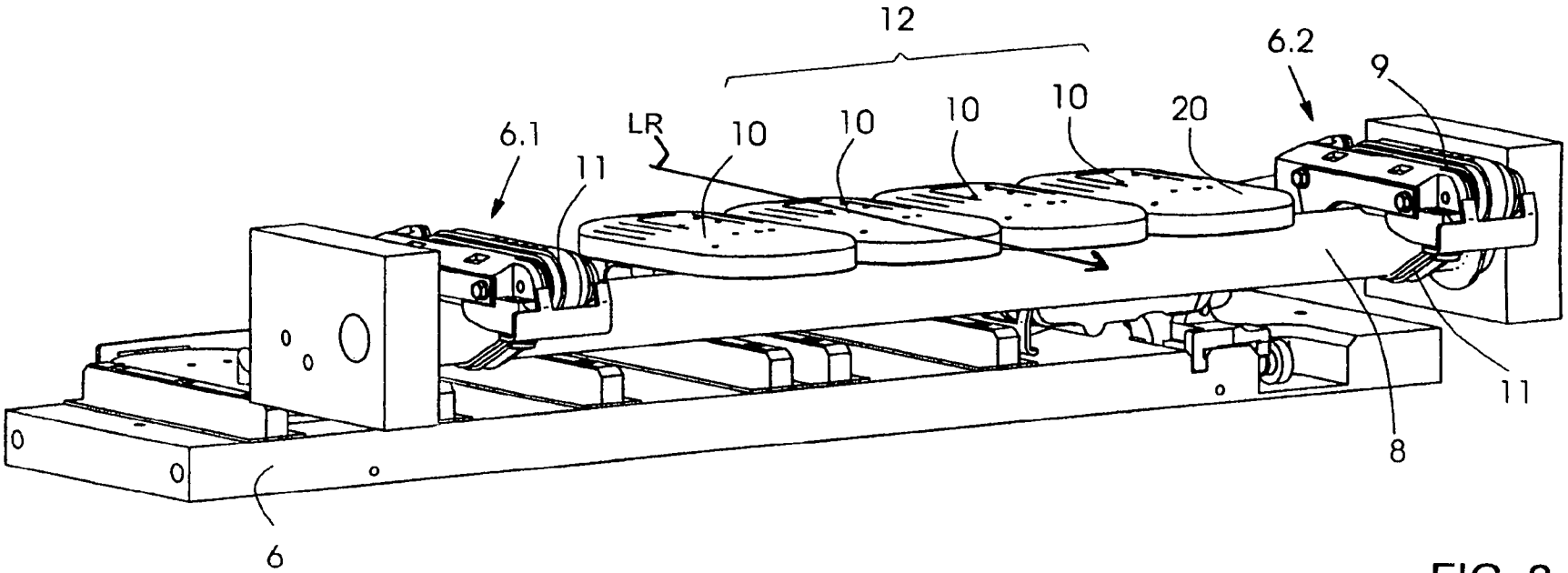
FIG. 2 is a diagrammatic, perspective view of sheet supports and braking units of the sheet brake from FIG. 1.

FIG. 2 shows that the sheet brake 6 contains only two modular braking units 6.1, 6.2, which can be set in an infinitely variable manner as a function of the format of the sheets 2 and of the position of their print-free corridors at the sheet edge. In this positioning process, the braking units 6.1 and 6.2 are displaced relative to one another along a common drive shaft 8.

Each braking unit 6.1, 6.2 contains two deflection rollers 9, a suction chamber to which vacuum is applied, and at least one endless brake band 11 as a circulating brake element, a brake belt also being understood here. The brake band 11 runs around the deflection rollers 9 and the drive shaft 8 that lies on the inside, and is driven frictionally by the latter for this purpose.

Furthermore, the sheet brake 6 contains a plurality of structurally identical sheet supports 10 that can be inserted optionally by the operating personnel between the braking units 6.1, 6.2 by quick release fastenings. The number of sheet supports 10 to be inserted is based on the sheet format of the respective print job and accordingly on the respective distance between the braking units 6.1, 6.2. As a rule, a plurality of sheet supports 10 are used in addition and form a row which is parallel to the drive shaft 8. The intermediate space present between the braking units 6.1, 6.2 in the respective sheet format is to be filled as far as possible by the sheet supports 10. For this reason, there is in every case a clear width or a distance of less than 15 centimeters which is to be measured between the respective braking unit 6.1 or 6.2 and the sheet support 10 which lies closest to the braking unit, and a distance of less than 5 centimeters which is to be measured from the sheet support 10 to an adjacent sheet support 10. According to FIG. 2, the sheet supports 10 are disposed so as to abut one another, with the result that the last-mentioned distance is practically zero.

Compressed air is applied periodically to the sheet supports 10, and the sheet supports 10 together form a blowing device 12 which bears the sheet 2, which is to be braked, during braking in a contactless manner by an air cushion. The air cushion is produced between a nozzle surface 20 of the respective sheet support 10 and the sheet 2, and is activated at the transport cycle of the arriving sheets 2. For this purpose, the blowing device 12 is connected to the compressed air source, and the latter is switched on and off cyclically.

Each nozzle surface 20 is rounded downward at its edge, the convex curvature contributing to the prevention of printing ink being smeared from the underside of the sheet 2 printed on both sides onto the nozzle surface 20. The curvature is configured in the form of a convex rounding of the circumferential edge of the nozzle surface 20, which rounding extends perpendicularly to the plane of the drawing of FIG. 3. In contrast to the rounding which cannot be seen in FIG. 3, a rounding of the corners of the nozzle surface 20 which extends in the plane of the drawing can be seen well in FIG. 3.

Figure 3:
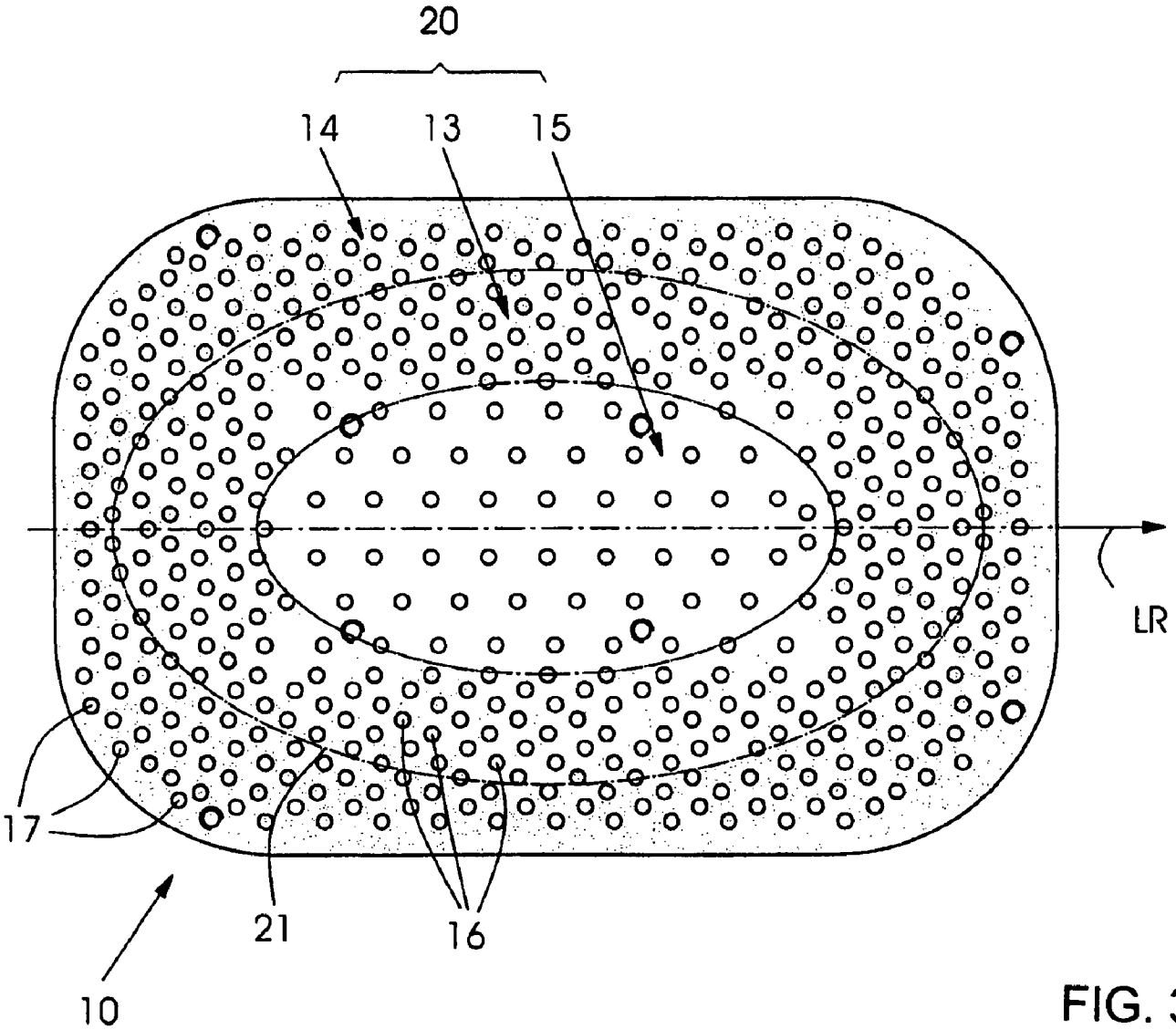
FIG. 3 is a diagrammatic, plan view of one of the sheet supports shown in FIG. 2.

Moreover, it is indicated in the drawing of FIG. 3 by use of different types of hatching that the nozzle surface 20 is subdivided into a first nozzle array 13, a second nozzle array 14 and a third nozzle array 15. The nozzle arrays 13 to 15 are disposed mirror-symmetrically with regard to a center axis of the sheet support 10 extending in a running direction LR of the sheets 2. The third nozzle array 15 has an oval shape and is disposed in the center of the nozzle surface 20. The second nozzle array 14 is disposed at the convexly rounded edge of the nozzle surface 20. The first nozzle array 13 is disposed between the inner, third nozzle array 15 and the outer, second nozzle array 14. The first nozzle array 13 and the second nozzle array 14 are in each case of an annular configuration.

The nozzle density, that is to say the number of nozzles per unit area, is smaller in the third nozzle array 15 than in the two other nozzle arrays 13, 14.

Each of the three nozzle arrays 13 to 15 contains a multiplicity of throttled air nozzles 16, 17, blown air volumetric flows VS1, VS2 (see FIG. 4) of the air nozzles 16, 17 being lowest in the third nozzle array 15, being highest in the second nozzle array 14, and being higher in the first nozzle array 13 than in the third nozzle array 15 but lower than in the second nozzle array 14. The magnitude of the blown air volumetric flows VS1, VS2 therefore increases from array to array from the center of the sheet support 10 toward its periphery. Here, for example, the first blown air volumetric flow VS1 of the first nozzle array 13 is meant as an average blown air volumetric flow of the air nozzles 16 disposed in the first nozzle array 13, and it is not ruled out that some of the air nozzles 16 which are disposed in the first nozzle array 13 deviate slightly from the average value with regard to their blown air volumetric flow.

Figure 4:
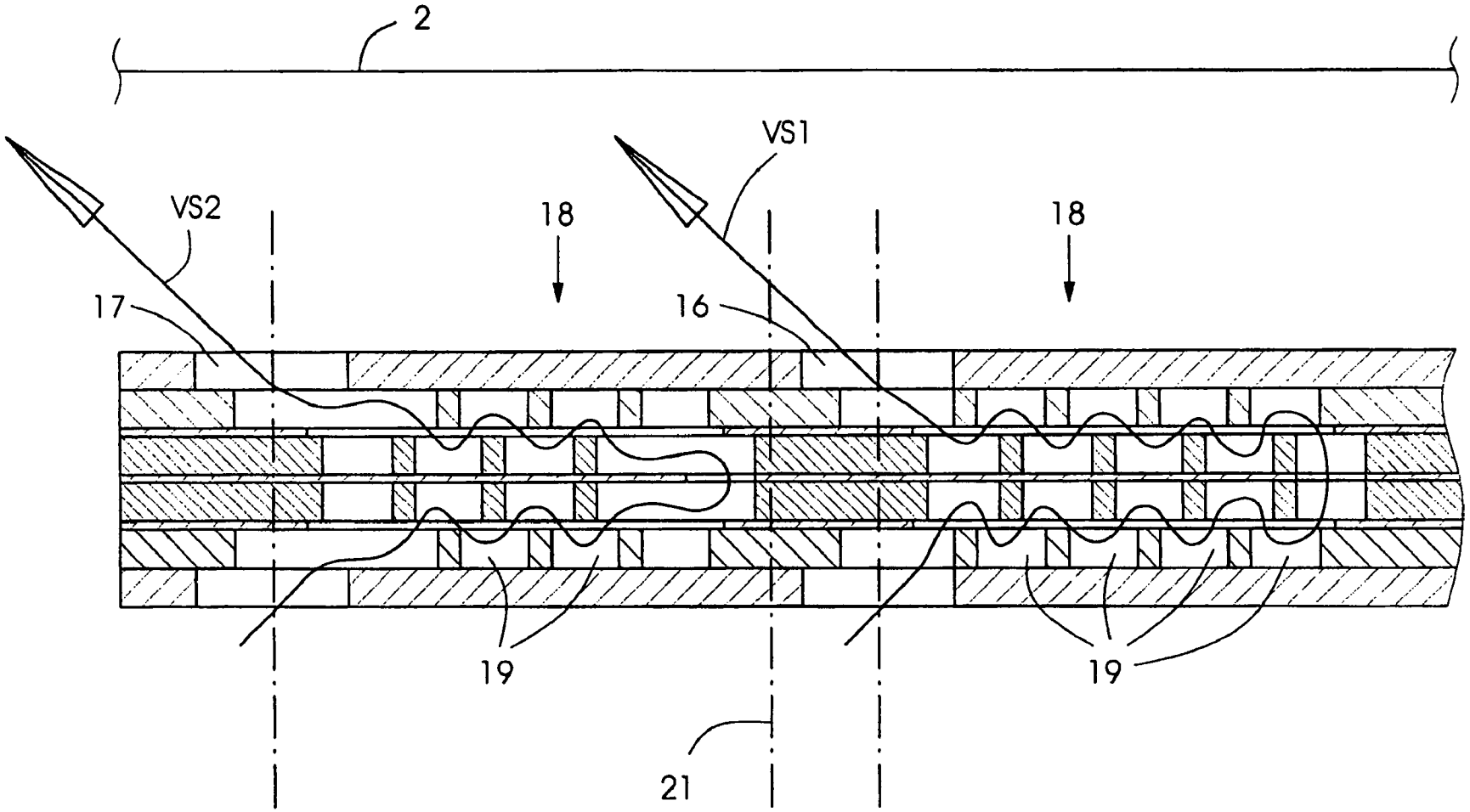
FIG. 4 is a diagrammatic, sectional view of restrictor nozzles of the sheet support shown in FIG. 3.

FIG. 4 uses the first and second nozzle arrays 13, 14 to show a technical implementation of the staggering of the blown air volumetric flows VS1, VS2 of different magnitudes. An imaginary separating line 21 is indicated which separates the first nozzle array 13 having the air nozzle 16 from the second nozzle array 14 having the air nozzle 17. Labyrinthine air restrictors 18 are connected ahead of the air nozzles 16, 17, via which air restrictors 18 the compressed air is applied to the air nozzles 16, 17. The air restrictor 18 of the air nozzle 16 of the first nozzle array 13 has more eddy chambers 19 and therefore a greater throttling action than the air nozzle 17 of the second nozzle array 14. In the example shown, the air restrictor 18 of the air nozzle 16 has twice as many eddy chambers 19, namely sixteen eddy chambers 19, as the air restrictor 18 of the air nozzle 17. As the different numbers of eddy chambers 19 determine the blown air volumetric flows VS1, VS2, the first blown air volumetric flow VS1 is smaller than the second blown air volumetric flow VS2. Air nozzles and associated air restrictors of the third nozzle array 15 are not shown in the drawing. The air restrictors of the third nozzle array 15 have in each case even fewer eddy chambers than the air restrictors 18 of the first nozzle array 13. For example, the air restrictors of the third nozzle array 15 have in each case four eddy chambers. The air restrictors 18 are preferably structurally identical within each one of the nozzle arrays 13 to 15 and, accordingly, are equipped with the same number of eddy chambers 19. The air restrictors of the nozzle arrays 13 to 15 are assembled from perforated plates in a sandwich construction.

This application claims the priority, under 35 U.S.C. § 119, of German patent application No. 10 2004 022 343.2, filed May 4, 2004; the entire disclosure of the prior application is herewith incorporated by reference.

We claim:

1. A sheet deliverer, comprising:

a chain conveyor;

a sheet brake disposed below said chain conveyor, said sheet brake containing:

circulating brake elements; and at least one sheet support for supporting sheets traveling in a running direction, said circulating brake elements spaced apart from each other transversely with respect to the running direction and adjustably mounted with respect to one another transversely to the running direction, said sheet support disposed between said circulating brake elements and forming a blowing device, said sheet support containing a first nozzle array having first air nozzles and a second nozzle array having second air nozzles, said first air nozzles of said first nozzle array producing blown air volumetric flows being smaller than blown air volumetric flows from said second air nozzles of said second nozzle array.

2. The sheet deliverer according to claim 1, wherein said second air nozzles of said second nozzle array are throttled to a lesser extent than said first air nozzles of said first nozzle array.

3. The sheet deliverer according to claim 1, further comprising labyrinthine air restrictions connected to said first air nozzles of said first nozzle array and said second air nozzles of said second nozzle array for producing different blown air volumetric flows.

4. The sheet deliverer according to claim 1, wherein said sheet support, said first nozzle array is disposed relatively centrally and said second nozzle array is disposed relatively decentrally.

5. The sheet deliverer according to claim 1, wherein said first nozzle array is surrounded annularly by said second nozzle array.

6. The sheet deliverer according to claim 1, wherein said sheet support has a curved nozzle surface.

7. The sheet deliverer according to claim 1, wherein said sheet support has nozzle densities which differ from one another from nozzle array to nozzle array.

8. The sheet deliverer according to claim 1, further comprising at least one further sheet support, said sheet support and said further sheet support are disposed in a row between said circulating brake elements.

9. A printing press, comprising:

a sheet deliverer containing a chain conveyor and a sheet brake disposed below said chain conveyor, said sheet brake including:

circulating brake elements; and at least one sheet support for supporting sheets traveling in a running direction, said circulating brake elements spaced apart from each other transversely with respect to the running direction and adjustably mounted with respect to one another transversely to the running direction, said sheet support disposed between said circulating brake elements and forming a blowing device, said sheet support containing a first nozzle array having first air nozzles and a second nozzle array having second air nozzles, said first air nozzles of said first nozzle array producing blown air volumetric flows being smaller than blown air volumetric flows from said second air nozzles of said second nozzle array.

* * * * *